US010806185B2

(12) United States Patent
Liu

(10) Patent No.: US 10,806,185 B2
(45) Date of Patent: Oct. 20, 2020

(54) ELECTRONIC CIGARETTE

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 330 days.

(21) Appl. No.: 16/045,696

(22) Filed: Jul. 25, 2018

(65) Prior Publication Data

US 2019/0357594 A1 Nov. 28, 2019

(30) Foreign Application Priority Data

May 24, 2018 (CN) ..... 2018 1 0504549

(51) Int. Cl.

| | |
|---|---|
| ***A24F 13/00*** | (2006.01) |
| ***A24F 47/00*** | (2020.01) |
| ***A24F 7/02*** | (2006.01) |
| ***H05B 3/44*** | (2006.01) |

(52) U.S. Cl.

CPC ..... *A24F 47/008* (2013.01); *A24F 7/02* (2013.01); *H05B 3/44* (2013.01); *H05B 2203/021* (2013.01)

(58) Field of Classification Search

CPC ..... A24F 47/00
USPC ..... 131/328–329
See application file for complete search history.

(56) References Cited

U.S. PATENT DOCUMENTS

| | | | | |
|---|---|---|---|---|
| 2017/0013881 | A1* | 1/2017 | Liu | A24F 47/008 |
| 2017/0354182 | A1* | 12/2017 | Liu | A24F 47/008 |
| 2018/0027874 | A1* | 2/2018 | Zhu | H05B 3/03 |
| 2019/0142069 | A1* | 5/2019 | Qiu | A24F 47/008 131/329 |

* cited by examiner

*Primary Examiner* — Phuong K Dinh
(74) *Attorney, Agent, or Firm* — Matthias Scholl P.C.; Matthias Scholl

(57) ABSTRACT

An electronic cigarette including a mouthpiece subassembly; an e-liquid charging subassembly; an atomizing subassembly; and a base subassembly. The mouthpiece subassembly is mounted on the e-liquid charging subassembly. The atomizing subassembly is screwed upon the base subassembly. The base subassembly is connected to the e-liquid charging subassembly. The mouthpiece subassembly includes a cigarette holder and a first seal ring. The first seal ring is coupled to the cigarette holder. The e-liquid charging subassembly includes an e-liquid charging member, a second seal ring, a sleeve ring, a third seal ring, and a glass tube. The second seal ring is disposed on the sleeve ring. The third seal ring is disposed in the bottom of the sleeve ring. The sleeve ring is embedded in the e-liquid charging member; the glass tube is connected to one end of the sleeve ring.

6 Claims, 7 Drawing Sheets

ELECTRONIC CIGARETTE

CROSS-REFERENCE TO RELATED APPLICATIONS

Pursuant to 35 U.S.C. § 119 and the Paris Convention Treaty, this application claims foreign priority to Chinese Patent Application No. 201810504549.2 filed May 24, 2018, the contents of which and any intervening amendments thereto are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, and Cambridge, Mass. 02142.

BACKGROUND

This disclosure relates to an electronic cigarette.

An electronic cigarette or e-cigarette is a cigarette substitute. It gives small amounts of the chemical nicotine without the tobacco or other chemicals from real cigarettes.

Typically, a mouthpiece assembly is non-detachably connected to an e-liquid charging subassembly of the electronic cigarettes. This increases the difficulty to replace the mouthpiece assembly and to load the e-liquid.

SUMMARY

The disclosure provides an electronic cigarette. The e-liquid can be charged to the electronic cigarette from the side wall of the electronic cigarette.

Disclosed is an electronic cigarette comprising a mouthpiece subassembly; an e-liquid charging subassembly; an atomizing subassembly; and a base subassembly. The mouthpiece subassembly is mounted on the e-liquid charging subassembly; the atomizing subassembly is screwed upon the base subassembly; the base subassembly is connected to the e-liquid charging subassembly.

The mouthpiece subassembly comprises a cigarette holder and a first seal ring; the first seal ring is tightly coupled to the cigarette holder.

The e-liquid charging subassembly comprises an e-liquid charging member, a second seal ring, a sleeve ring, a third seal ring, and a glass tube; the second seal ring is disposed on the sleeve ring; the third seal ring is disposed in a bottom of the sleeve ring; the sleeve ring is embedded in the e-liquid charging member; the glass tube is connected to one end of the sleeve ring, and the other end of the sleeve ring is connected to the mouthpiece subassembly.

The atomizing subassembly comprises a fourth seal ring, a limit cover, a silica ring, a first cotton, a heating wire, a second cotton, a fixed ring, a first insulation ring, and a first joint; the heating wire is wrapped by the second cotton and disposed in the fixed ring; the limit cover limits the heating wire, the fourth seal ring is disposed on the limit cover; the first insulation ring and the first joint are disposed on the bottom of the fixed ring; the first cotton wraps the fixed ring; the first cotton and the fixed ring are inserted in the limit cover; the fourth seal ring and the silica ring are disposed at two ends of the limit cover, respectively.

The base subassembly comprises a fifth seal ring, a press part, sixth seal rings, a vapor adjusting ring, a base, a second insulation ring, and a second joint; the second insulation ring and the second joint are disposed in the base; the sixth seal rings are disposed on two ends of the base, respectively; the vapor adjusting ring is screwed on the base; the press part presses on the base; and the fifth seal ring is fixed on the press part.

The cigarette holder can be detachably disposed on the e-liquid charging subassembly, and can be connected to the sleeve ring of the e-liquid charging subassembly.

The sleeve ring can comprise a side wall; the side wall can be provided with an orifice allowing the e-liquid to pass through; the sleeve ring can be detachably connected to the e-liquid charging member and seals the orifice.

The vapor adjusting ring can be in threaded connection to the base, and the vapor adjusting ring can comprise a circumferential wall which is provided with a transverse and/or longitudinal hole.

The electronic cigarette of the disclosure comprises a removable mouthpiece subassembly, which facilitates the replacement of the mouthpiece subassembly. In addition, the e-liquid can be loaded to the atomizer of the electronic cigarette from the side of the top part of the electronic cigarette. The vapor adjusting ring is in threaded connection to the base, so the rotation of the vapor adjusting ring can change the output volume of the vapor. The atomizing subassembly is supported by the base subassembly. The base subassembly can be screwed out to replace the atomizing subassembly.

DETAILED DESCRIPTION

Figure 1:
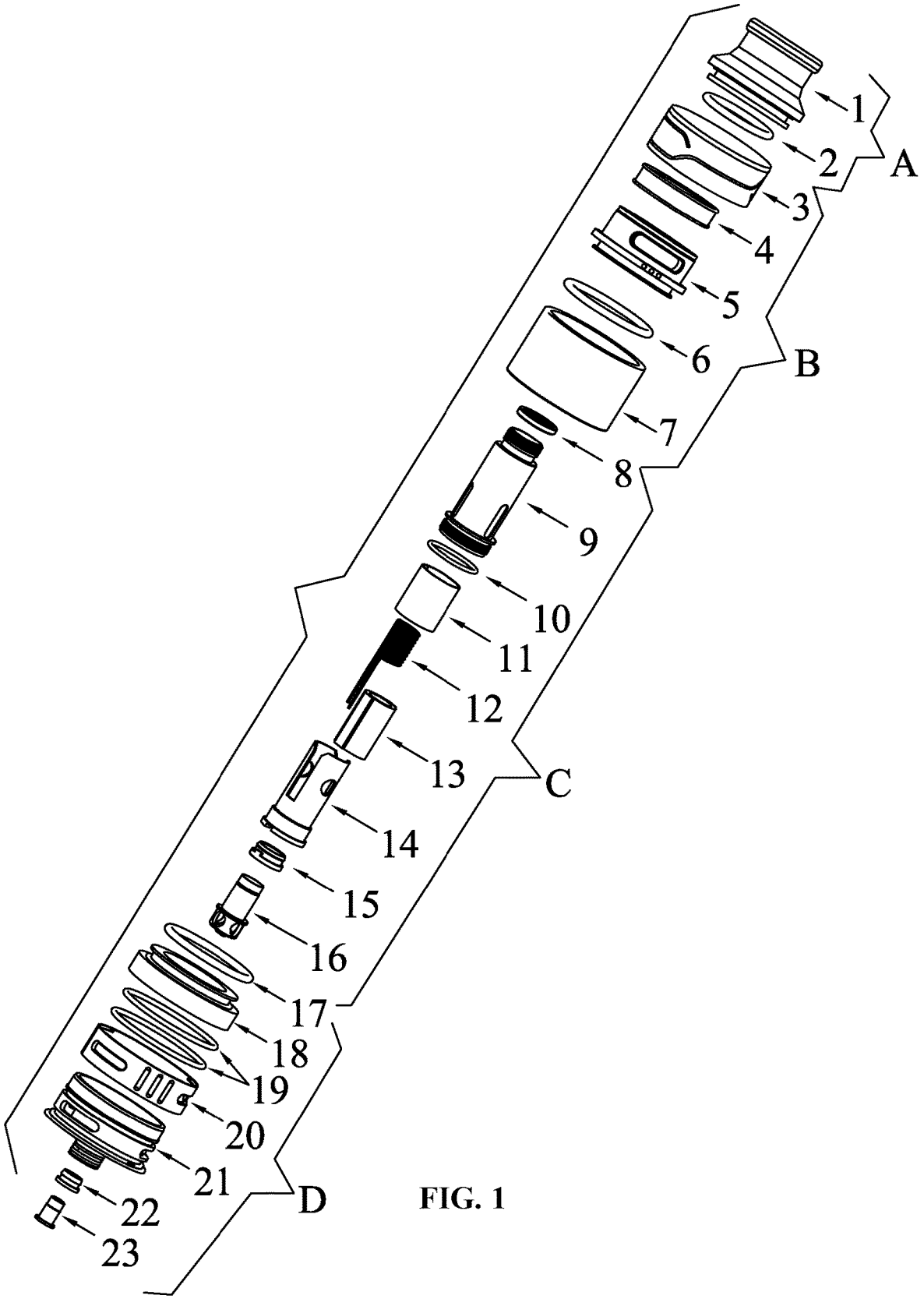
FIG. 1 is an exploded view of an electronic cigarette of the disclosure.
Figure 2:
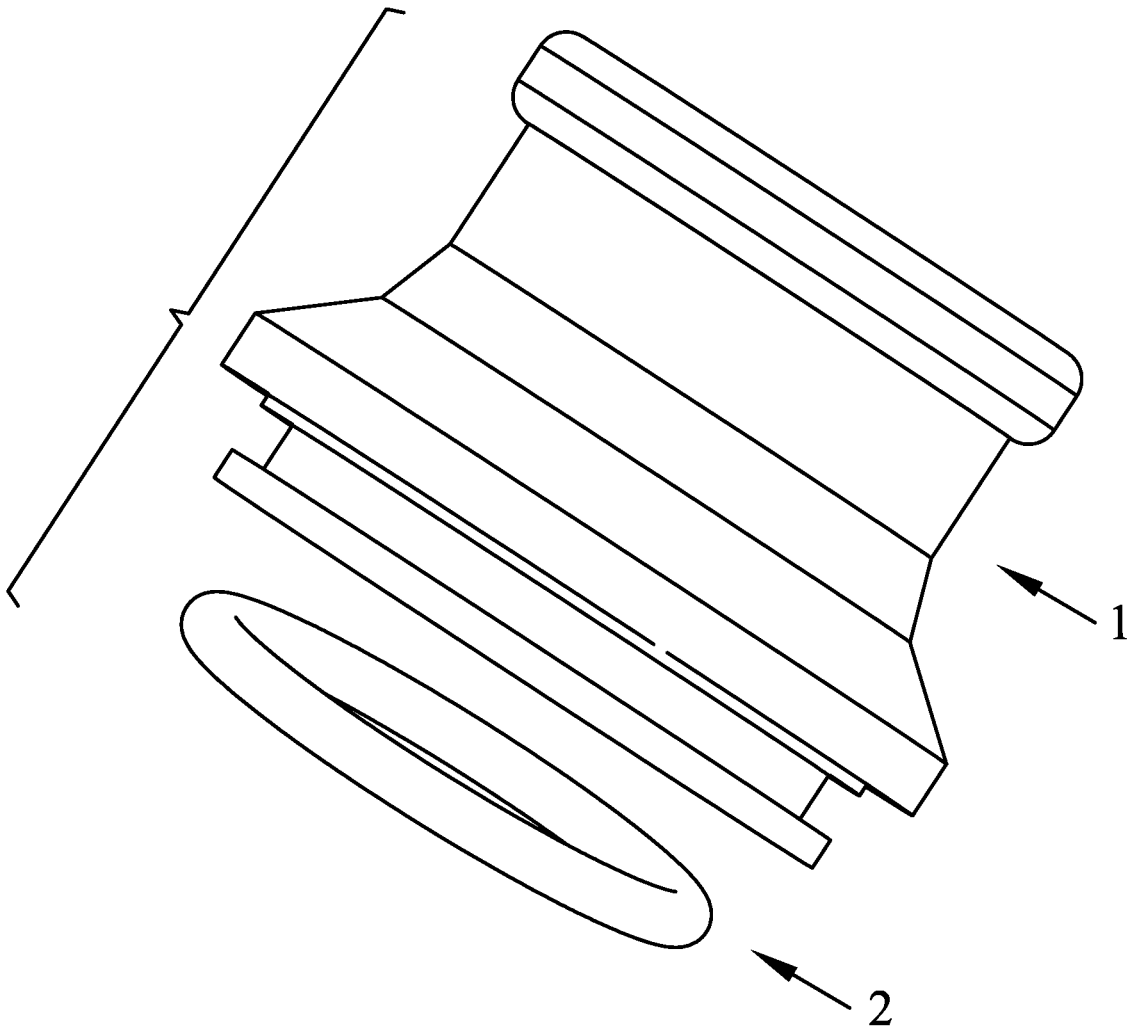
FIG. 2 is an exploded view of a mouthpiece subassembly of an electronic cigarette of the disclosure.
Figure 3:
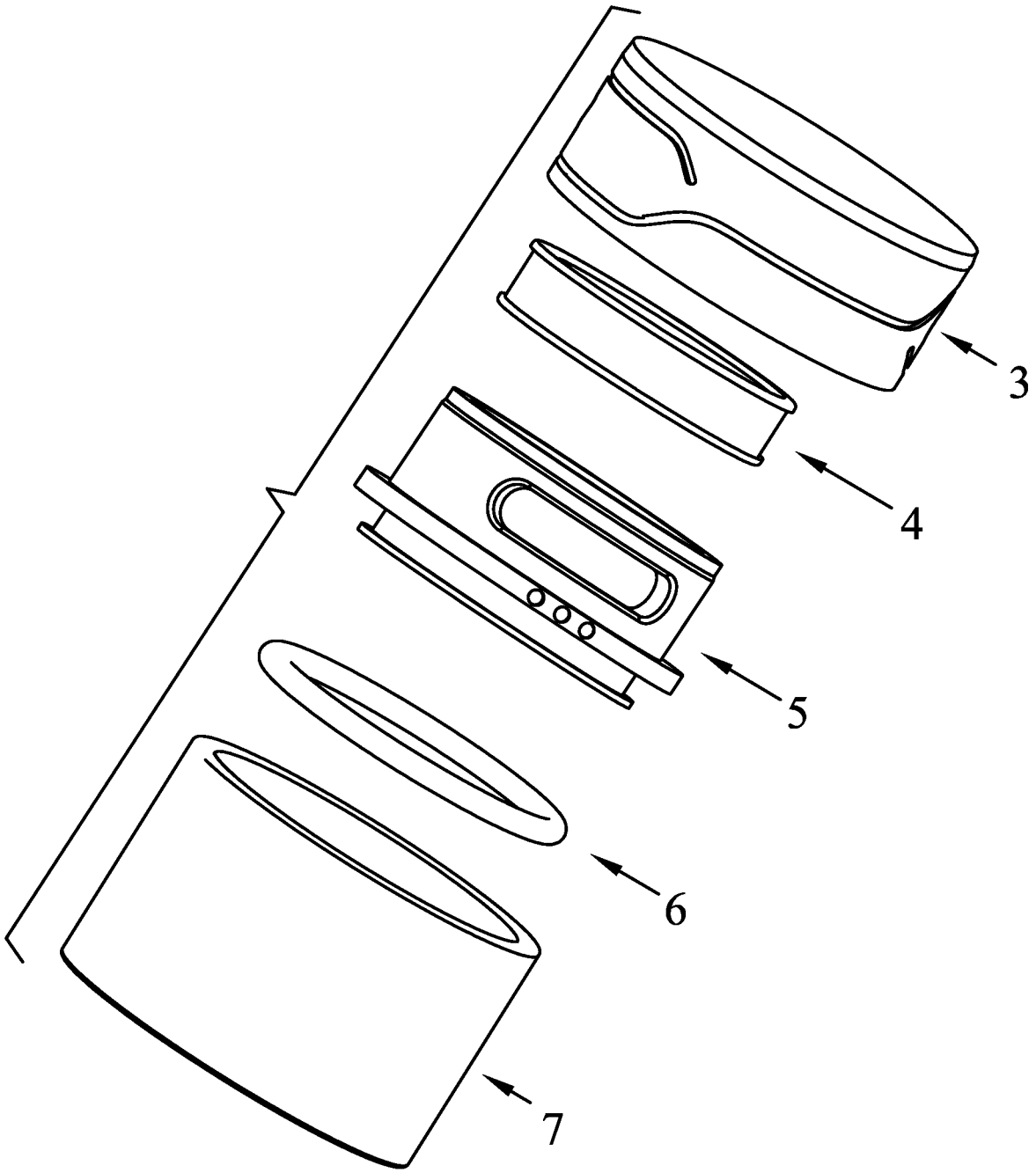
FIG. 3 is an exploded view of an e-liquid charging subassembly of an electronic cigarette of the disclosure.
Figure 4:
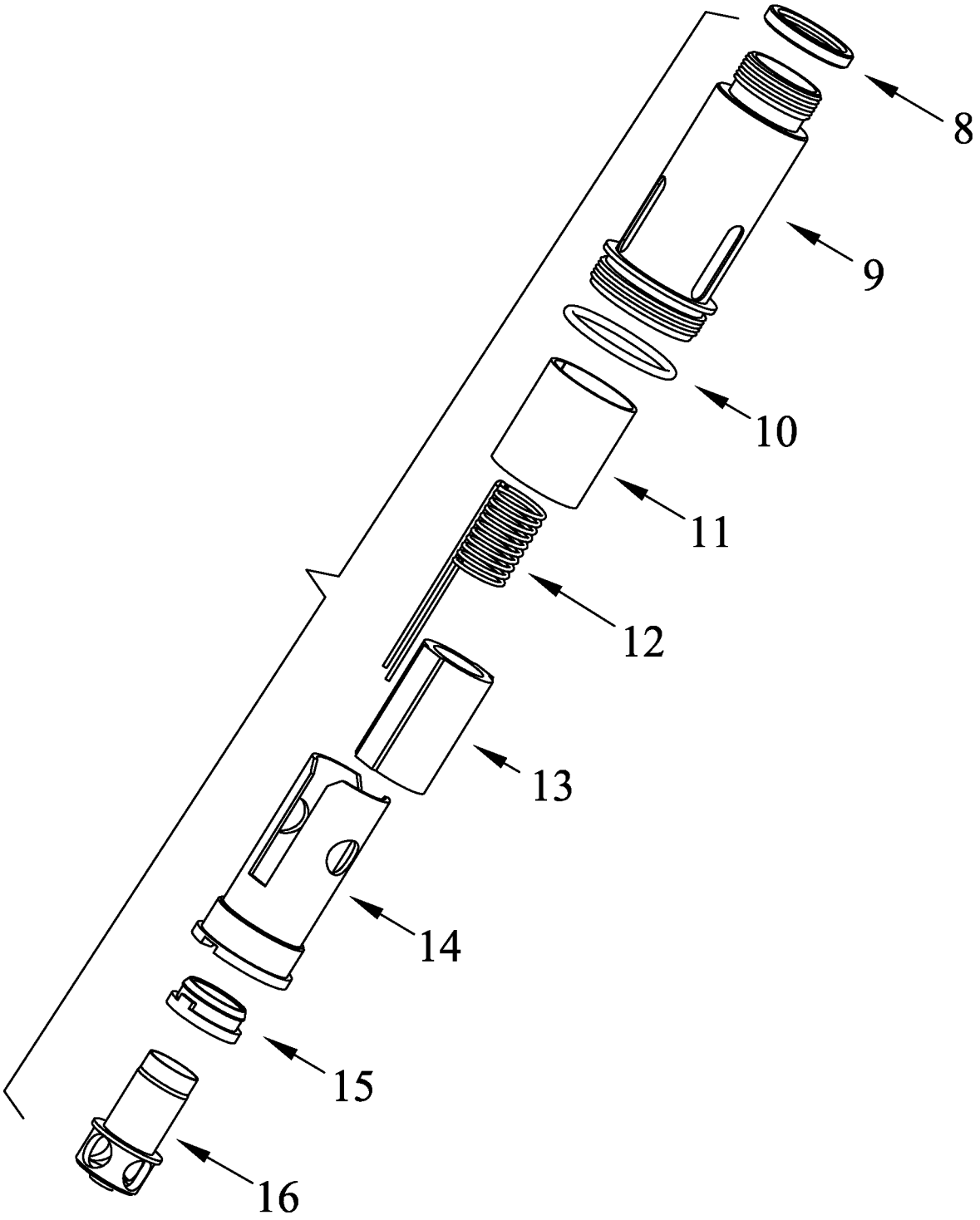
FIG. 4 is an exploded view of an atomizing subassembly of an electronic cigarette of the disclosure.
Figure 5:
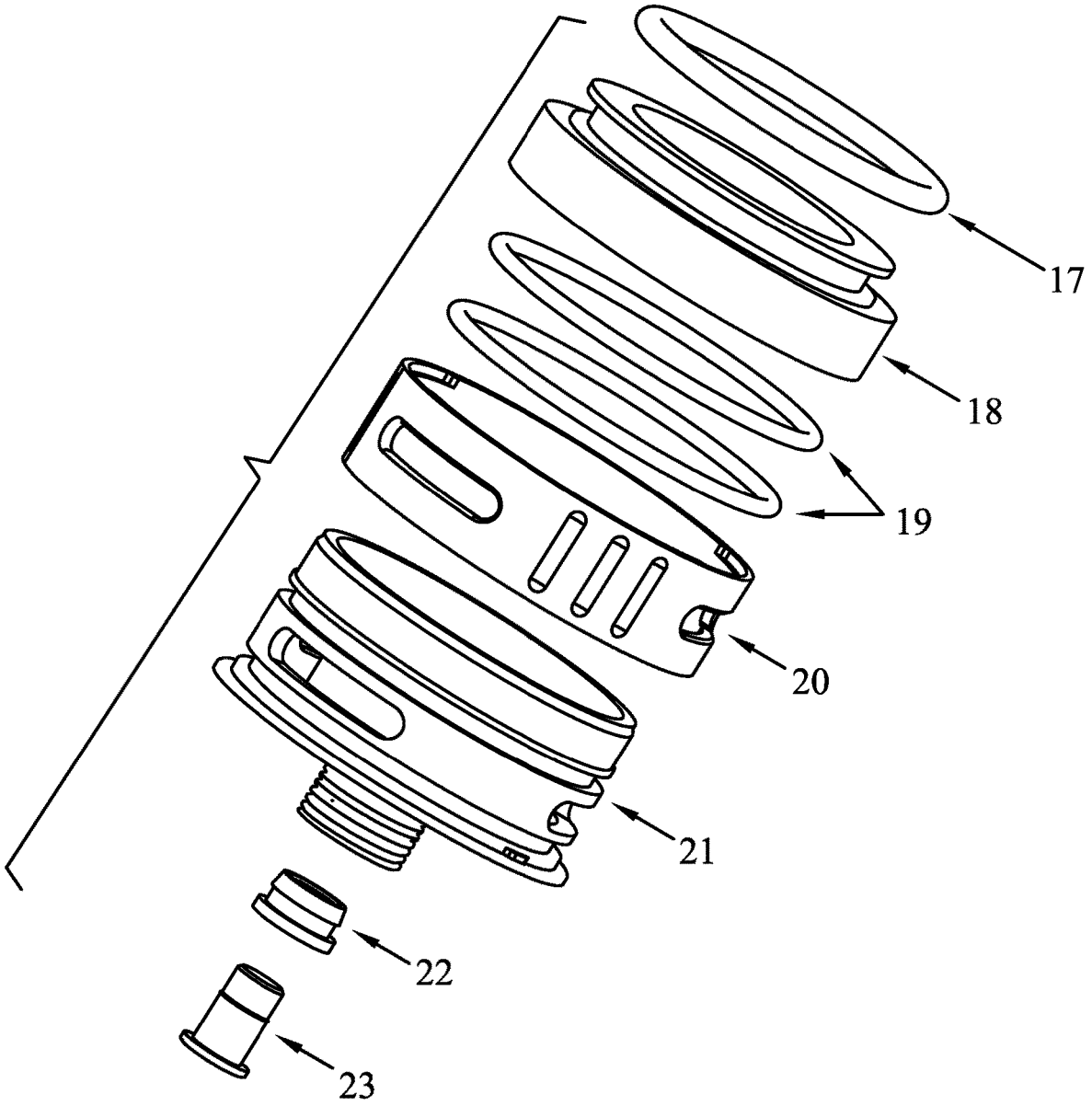
FIG. 5 is an exploded view of a base subassembly of an electronic cigarette of the disclosure
Figure 6:
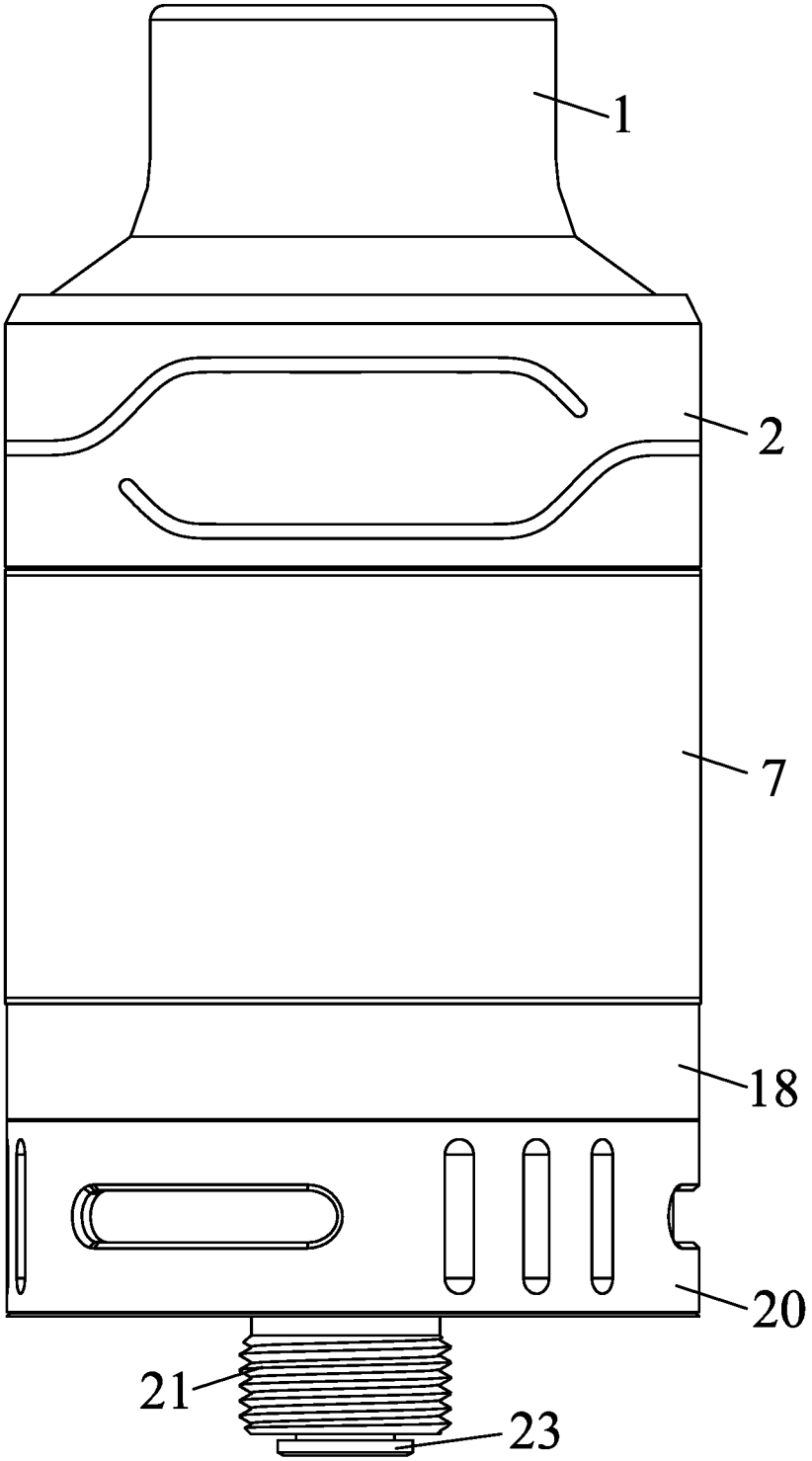
FIG. 6 is a stereogram of an electronic cigarette of the disclosure.
Figure 7:
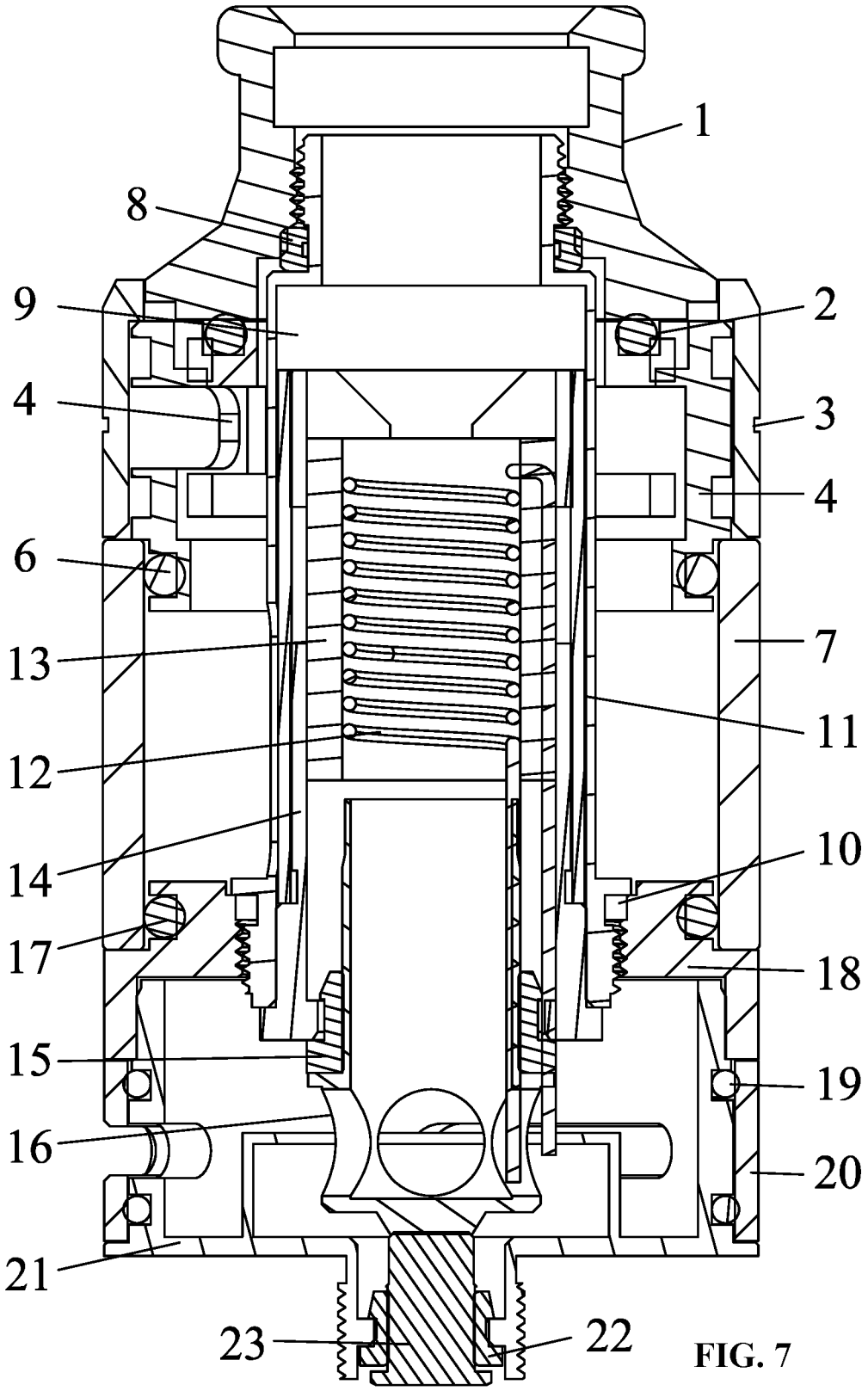
FIG. 7 is a sectional view of an electronic cigarette of the disclosure.

For further illustrating the invention, experiments detailing an electronic cigarette are described below. It should be noted that the following examples are intended to describe and not to limit the invention.

The disclosure provides an electronic cigarette comprising: a mouthpiece subassembly A; an e-liquid charging subassembly B; an atomizing subassembly C; and a base subassembly D. The mouthpiece subassembly A is mounted on the e-liquid charging subassembly B. The atomizing subassembly C is screwed upon the base subassembly D; the base subassembly D is connected to the e-liquid charging subassembly B. The mouthpiece subassembly A comprises a cigarette holder 1 and a first seal ring 2; the first seal ring 2 is tightly coupled to the cigarette holder 1.

The e-liquid charging subassembly B comprises an e-liquid charging member 3, a second seal ring 4, a sleeve ring 5, a third seal ring 6, and a glass tube 7; the second seal ring 4 is disposed on the sleeve ring 5; the third seal ring 6 is disposed in a bottom of the sleeve ring 5; the sleeve ring 5 is embedded in the e-liquid charging member 3; the glass tube 7 is connected to one end of the sleeve ring 5, and the other end of the sleeve ring 5 is connected to the mouthpiece subassembly.

The atomizing subassembly C comprises a fourth seal ring 8, a limit cover 9, a silica ring 10, a first cotton 11, a heating wire 12, a second cotton 13, a fixed ring 14, a first insulation ring 15, and a first joint 16; the heating wire 12 is wrapped by the second cotton 13 and disposed in the fixed ring 14; the limit cover 9 limits the heating wire 12, the fourth seal ring is disposed on the limit cover; the first insulation ring 15 and the first joint 16 are disposed on a bottom of the fixed ring 14; the first cotton 11 wraps the fixed ring 14; the first cotton 11 and the fixed ring 14 are inserted in the limit cover 9; the fourth seal ring 8 and the silica ring 10 are disposed at two ends of the limit cover 9, respectively.

The base subassembly D comprises a fifth seal ring 17, a press part 18, sixth seal rings 19, a vapor adjusting ring 20, a base 21, a second insulation ring 22, and a second joint 23; the second insulation ring 22 and the second joint 23 are disposed in the base 21; the sixth seal rings 19 are disposed on two ends of the base 21, respectively; the vapor adjusting ring 20 is screwed on the base 21; the press part 18 presses on the base 21; and the fifth seal ring 17 is fixed on the press part 18.

Preferably, as an improvement, the cigarette holder 1 is detachably disposed on the e-liquid charging subassembly B, and is connected to the sleeve ring 5 of the e-liquid charging subassembly B. Because the cigarette holder 1 is removable, it is easy to replace an odd one.

Preferably, as an improvement, the sleeve ring 5 comprises a side wall; the side wall is provided with an orifice allowing the e-liquid to pass through; the sleeve ring 5 is detachably connected to the e-liquid charging member 3 and seals the orifice. In use, the e-liquid charging member 3 is taken out, the orifice on the side wall of the sleeve ring 5 is exposed, so that the e-liquid can be charged into the atomizer of the electronic cigarette, achieving the loading of the e-liquid from the side of the top part of the electronic cigarette.

Preferably, as an improvement, the vapor adjusting ring 20 is in threaded connection to the base, and the vapor adjusting ring 20 comprises a circumferential wall which is provided with a transverse and/or longitudinal hole. Through adjusting the tightness of the screw thread of the vapor adjusting ring and/or altering the sectional area of the transverse and/or longitudinal hole, the output volume of the vapor can be controlled.

The electronic cigarette of the disclosure comprises a removable mouthpiece subassembly, which facilitates the replacement of the mouthpiece subassembly. In use, the e-liquid charging member can be taken out directly, the orifice on the side wall of the sleeve ring is exposed, so that the e-liquid can be charged into the atomizer of the electronic cigarette, achieving the loading of the e-liquid from the side of the top part of the electronic cigarette. The vapor adjusting ring is in threaded connection to the base, so the rotation of the vapor adjusting ring can change the output volume of the vapor. The atomizing subassembly is supported by the base subassembly. The base subassembly can be screwed out to replace the atomizing subassembly.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An electronic cigarette, comprising:

a mouthpiece subassembly;

an e-liquid charging subassembly;

an atomizing subassembly; and a base subassembly;

wherein:

the mouthpiece subassembly is mounted on the e-liquid charging subassembly;

the atomizing subassembly is screwed upon the base subassembly;

the base subassembly is connected to the e-liquid charging subassembly;

the mouthpiece subassembly comprises a cigarette holder and a first seal ring; the first seal ring is coupled to the cigarette holder;

the e-liquid charging subassembly comprises an e-liquid charging member, a second seal ring, a sleeve ring, a third seal ring, and a glass tube; the second seal ring is disposed on the sleeve ring; the third seal ring is disposed in a bottom of the sleeve ring; the sleeve ring is embedded in the e-liquid charging member; the glass tube is connected to one end of the sleeve ring, and the other end of the sleeve ring is connected to the mouthpiece subassembly;

the atomizing subassembly comprises a fourth seal ring, a limit cover, a silica ring, a first cotton, a heating wire, a second cotton, a fixed ring, a first insulation ring, and a first joint; the heating wire is wrapped by the second cotton and disposed in the fixed ring; the limit cover limits the heating wire, the fourth seal ring is disposed on the limit cover; the first insulation ring and the first joint are disposed on a bottom of the fixed ring; the first cotton wraps the fixed ring; the first cotton and the fixed ring are inserted in the limit cover; the fourth seal ring and the silica ring are disposed at two ends of the limit cover, respectively; and the base subassembly comprises a fifth seal ring, a press part, sixth seal rings, a vapor adjusting ring, a base, a second insulation ring, and a second joint; the second insulation ring and the second joint are disposed in the base; the sixth seal rings are disposed on two ends of the base, respectively; the vapor adjusting ring is screwed on the base; the press part presses on the base; and the fifth seal ring is fixed on the press part.

2. The electronic cigarette of claim 1, wherein the cigarette holder is detachably disposed on the e-liquid charging subassembly and is connected to the sleeve ring of the e-liquid charging subassembly.

3. The electronic cigarette of claim 1, wherein the sleeve ring comprises a side wall; the side wall is provided with an orifice allowing the e-liquid to pass through; the sleeve ring is detachably connected to the e-liquid charging member and seals the orifice.

4. The electronic cigarette of claim 2, wherein the sleeve ring comprises a side wall; the side wall is provided with an orifice allowing the e-liquid to pass through; the sleeve ring is detachably connected to the e-liquid charging member and seals the orifice.

5. The electronic cigarette of claim 1, wherein the vapor adjusting ring is in threaded connection to the base, and the vapor adjusting ring comprises a circumferential wall which is provided with a transverse and/or longitudinal hole.

6. The electronic cigarette of claim 2, wherein the vapor adjusting ring is in threaded connection to the base, and the vapor adjusting ring comprises a circumferential wall which is provided with a transverse and/or longitudinal hole.

* * * * *